United States Patent [19]

Ingermann et al.

[11] 4,246,674

[45] Jan. 27, 1981

[54] AUTOMATIC BOWLING LANE STRIPPER

[75] Inventors: Donald E. Ingermann, Arvada; Eldon G. Sauer, Broomfield; Ronald L. Smith, Boulder, all of Colo.

[73] Assignee: Century International Corp., Golden, Colo.

[21] Appl. No.: 73,737

[22] Filed: Sep. 10, 1979

[51] Int. Cl.[3] ..... A47L 11/282

[52] U.S. Cl. ..... 15/4; 15/98

[58] Field of Search ..... 15/4, 51, 52, 98, 99

[56] References Cited

U.S. PATENT DOCUMENTS

| | | | |
|---|---|---|---|
| 3,216,037 | 11/1965 | Stevens et al. | 15/98 |
| 3,418,672 | 12/1968 | Regan | 15/98 |
| 3,604,037 | 9/1971 | Varner | 15/4 |
| 3,868,738 | 3/1975 | Horst et al. | 15/4 |

*Primary Examiner*—Edward L. Roberts

*Attorney, Agent, or Firm*—Edwin L. Spangler, Jr.

[57] ABSTRACT

This invention relates to an automatic self-propelled machine for stripping oil from bowling lanes which is characterized by a solvent applicator made of absorbant material that applies the oil-dissolving solvent to the lane surface, means for moving the applicator into engagement with the lane surface at predetermined points in the excursion of the stripper, a cam-actuated solvent supply system automatically operative to wet the applicator during a portion of its forward travel toward the pin deck and return trip to the foul line, a rotating residue pick-up roller for continuously picking up the liquid and solid residues from the surface of the lane during both forward and return excursions of the stripper, and a moving curtain wiper mechanism positioned between the applicator and residue pick-up roller in contact with the absorbant surface of the latter and preferably also with the lane surface effective during both the forward and return runs to remove the residues from the pick-up drum as it dries the lane. The invention also relates to a novel arrangement of drive rollers, support rollers and casters cooperating with one another and with the various mechanisms for applying the solvent and removing same that both guide the unit and insure treatment of the lane all the way from the foul line to the pin deck. In addition, the invention encompasses a control system including lane position sensing mechanisms which govern the movements of the stripper as well as its operating cycle.

10 Claims, 9 Drawing Figures

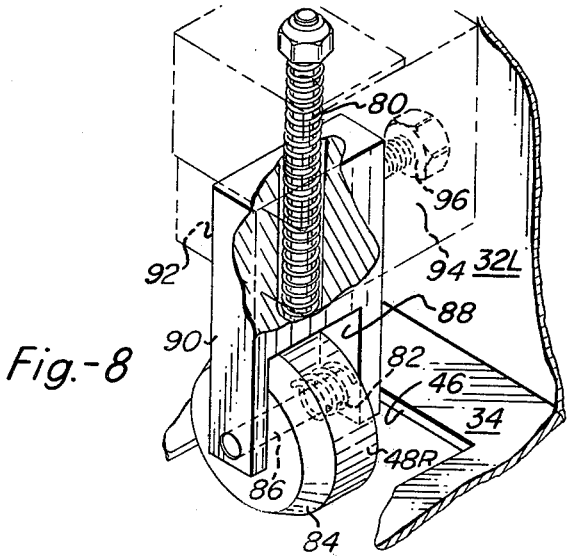
Fig.-8
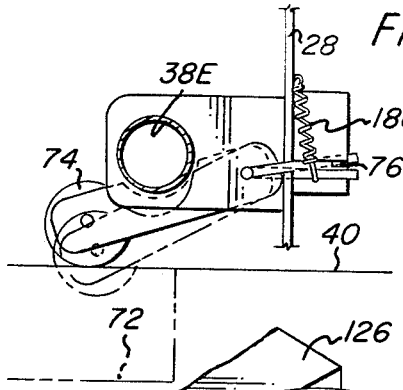
Fig.-5
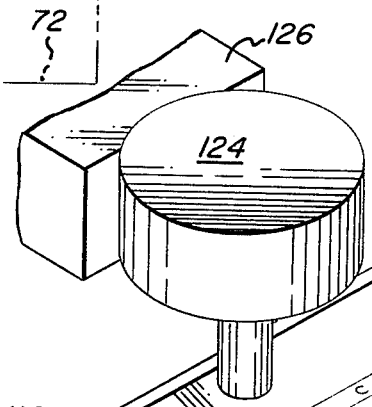
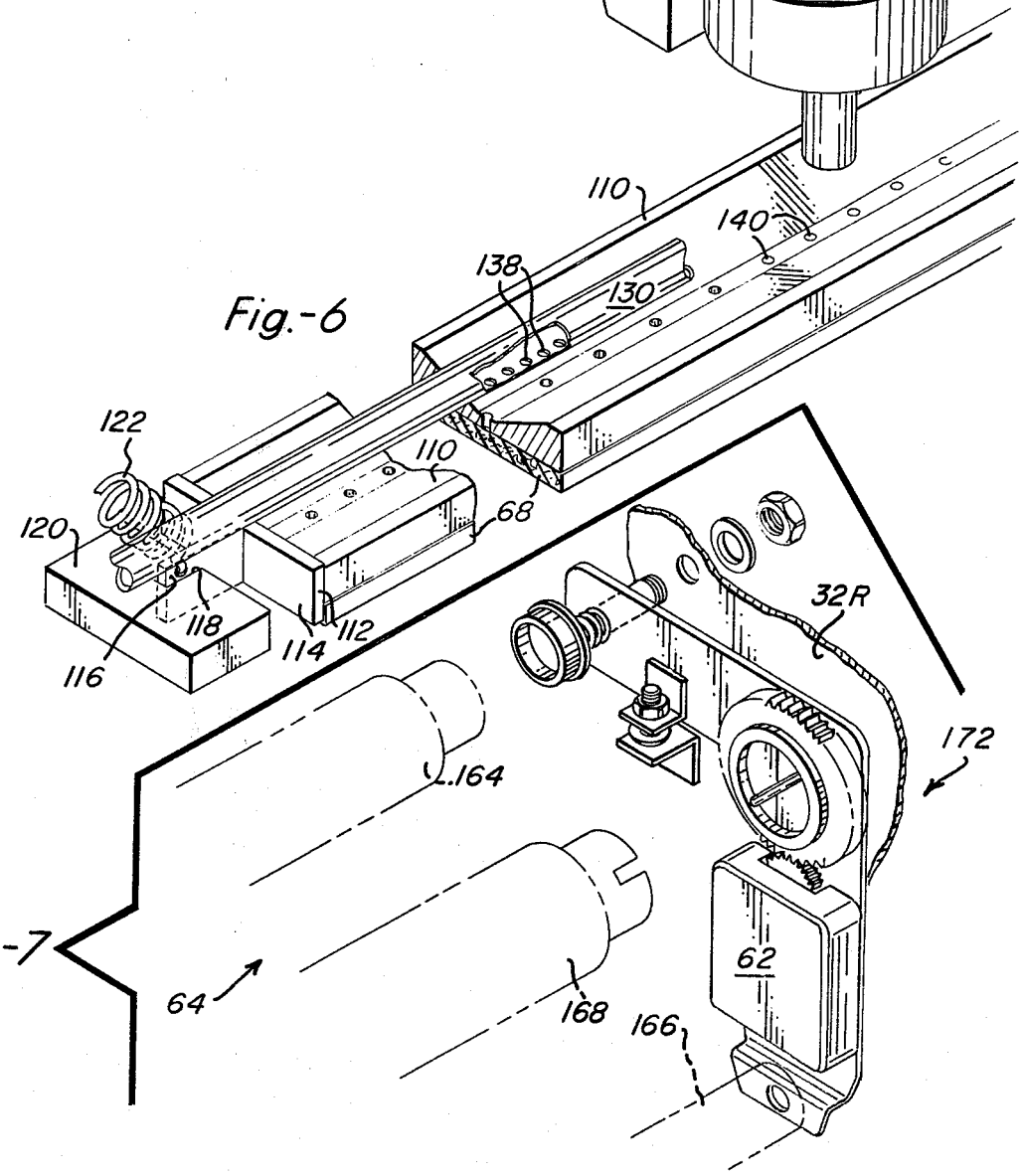
Fig.-6
Fig.-7

AUTOMATIC BOWLING LANE STRIPPER

The closest and most pertinent prior art known to applicant is that which forms the subject matter of U.S. Pat. Nos. 3,604,037 and 3,868,738 both of which are now owned by the assignee hereof. The first of these patented lane conditioning machines has proven to be very versatile and eminently satisfactory for performing a variety of necessary operations but it is quite expensive due to its complexity, so expensive in fact that many operators of the smaller bowling alleys just cannot afford one. It includes buffers, applicators for applying both lane dressings and solvents, dusting mechanisms using moving cloth webs, lane position sensors and sophisticated cam actuated controls for initiating and terminating the various operations at different, yet rather accurately located positions along the lane. More specifically, the primary functions to be performed by the machine disclosed in the Varner patent were those of dressing the first 45 feet of the lane with a thin coating of oil and then stripping all oil, dust and dirt from the remainder of the lane all the way back to the pin deck on a daily basis. This stripping operation utilized a rotating drum-type applicator to which the solvent was applied as it turned. Since the amount of oil on the remote end of the lane is basically only that which is carried there by the ball as it rolls from the dressed section toward the pins, it is easily removed with a very small amount of solvent, i.e. from $\frac{1}{8}$ oz. up to less than 1 oz. For this purpose, the solvent applicator of the Varner patent proved to be quite satisfactory; however, when attempts were made to expand its function and clean the much greater quantity of dirt and oil from the dressed portion of the lane, the system failed. There appeared to be several reasons for this, not the least of which was the inability of the rotating applicator to handle the accumulation of dirt and oil so as to leave the lane stripped of all foreign matter. The roller itself could not hold enough solvent to properly remove the oil from the dressed section of the lane and, as a result, any applicator subassembly for use on this part of the lane would, of necessity, have to be redesigned.

In addition to the rotating cylindrical applicator, the pressurized solvent reservoir and system of nozzles for wetting the applicator proved to be a source of trouble when attempts were made to adapt them to the volume of solvent needed to strip the dressed section of the lane. Thus, while it appeared that it was only necessary to make minor changes in the existing lane cleaning system of the Varner unit to adapt it for use in cleaning the dressed section of the lane, this proved to be an erroneous assumption when, as a matter of fact, the existing system was totally inadequate to handle the considerably greater volume of solvent needed to effectively clean this area of the lane.

Another analogous, but nonetheless different, problem was that of picking up the suspension consisting of the insoluble particulate matter suspended in the solvent with the oil dissolved therein so as to leave the lane clean and ready to be dressed. In the Varner unit, small amounts of solvent were sprayed onto a pad which rested atop the rotating applicator and transferred the solvent thereto. Also engaging this applicator was a dust cloth which removed the dust from its surface. While provision was made for unrolling the dust cloth when the area thereof in contact with the applicator got dirty, no fresh dust removal surface was supplied on a continuous basis nor was one needed since the amount of dust picked up by the applicator on the undressed part of the lane was minimal. A continuously changing dust cloth was passed underneath a wiper pad at the opposite end of the unit but it was not intended, nor was it used, to clean solvent and particulate matter from the wet applicator. The stationary dust cloth in contact with the applicator proved to be useless in removing from the rotating applicator the vastly greater amount of solvent it had to be supplied with in order to clean the dressed section of the lane.

Accordingly, while the Varner machine appeared to include the elements necessary to apply solvent and remove same along with the entrained particular matter from the dressed section of the lane and leave it clean, this was not the case and the unit was found to be totally inadequate when attempts were made to modify it for use in the above manner.

Assignee's other U.S. Pat. No. 3,868,738 refers to the need for a lane-conditioning machine that is both less complicated and less expensive than the one forming the subject matter of the Varner patent. The latter unit differs materially from the former one in that it includes no provision for stripping oil from the lanes. Instead, it only applies an oil dressing thereto, buffs and dusts the lane. Furthermore, none of the subassemblies present in the Horst et al machine is any more satisfactory than those of the Varner patent for either stripping the oil from the dressed areas of the lane or removing the residues left following such an operation.

The net result as far as the bowling alley proprietor is concerned is that he or she must still manually strip the oil from the dressed portions of the lane on a periodic basis, usually once a week. The Varner machine is effective on a daily basis to strip the oil from the undressed sections of the lane and to re-oil the dressed section but not to strip it. The Horst et al machine, on the other hand, is even more limited since it can only dress the lane and it includes no provision for stripping it whatsoever.

It has now been found in accordance with the teaching of the instant invention that an automatic lane stripping machine is a much needed adjunct to assignee's existing pair of patented conditioning machines referred to previously. The primary requirement of such a machine is, first of all, to completely strip the oil and insoluble particulate matter from both the dressed and undressed sections of the lane. A second, but no less significant requirement is the removal of the residue left on the lane following the stripping operation. These and other requirements have been realized by the simple, yet unobvious, expedient of replacing the driven roller type applicator with a wettable pad that remains in contact with the lane surface during the excursion of the machine from the foul line all the way to the pin deck. Solvent is applied directly to this pad in amounts anywhere from about seven to over a hundred times that which the Varner unit is capable of handling using the wiping action by means of which solvent is transferred from a wiper pad to the surface of the applicator roller. Equally unique is the use of a moving web of absorbant material to not only dust the lane as in the previously-described machines but, more importantly, to continuously wipe the absorbant surface of the rotating pick-up roller and remove the solid and liquid residues therefrom before they can be returned to the surface of the lane. The dusting function of the moving web and the buffing function of the residue pick-up roller, while significant, are nonetheless subordinate to their main functions of removing all liquid and solid residues left over following the stripping operation from the surface of the lane since, in each instance, the lane will be re-oiled and buffed with other machinery or by hand before being used.

The remaining novel aspects of the stripper have to do with the way in which it is supported as it runs to and fro along the lane and its various operations controlled as a function of its location as determined by feelers and means responsive to the main carriage drive. More specifically, the applicator is charged with its supply of solvent during portions of both its forward and return runs, the latter while it is raised up into its inoperative position thus giving the charge an opportunity to disburse evenly along the pad before becoming operative again. Some of these same feelers sense the position of the unit so as to reverse its direction of movement, deactuate the applicator while re-activating the solvent supply mechanism in a manner to charge the latter with solvent and terminate the stripping cycle as the unit returns to the foul line.

It is, therefore, the principal object of the present invention to provide a self-propelled machine for stripping the oil and other foreign matter from the surface of a bowling lane.

A second objective is the provision of a device of the class described which continuously picks up both the solid and liquid residues left on the surface of the lane following the stripping operation and transfers same to a moving curtain of absorbant material.

Another object of the herein described invention is the provision of a bowling lane stripping apparatus which incorporates sensors effective to locate the position of the unit along the lane and control mechanisms responsive to said sensors for initiating and terminating its various functions.

Still another object is to provide a novel solvent applicator and means for supplying the latter with solvent which are capable of handling charges of solvent far in excess of those found in the prior art lane conditioning machines equipped with strippers.

An additional object is the provision of a device of the character described which is completely automatic in terms of its operating cycle except for the initial run where the applicator pad is preferably charged with solvent by hand or otherwise presoaked.

Further objects are to provide a bowling lane stripper that is versatile, efficient, portable, easy to use, dependable, safe, simple to service, compact and even somewhat decorative.

Other objects will be in part apparent and in part pointed out specifically hereinafter in connection with the description of the drawings that follows, and in which:

FIG. 5 is a fragmentary detail to a scale somewhat larger than FIG. 4 showing the reversing mechanism at the front of the unit;

FIG. 6 is a fragmentary perspective view to about the same scale as FIG. 5, portions of which have been broken away to better reveal the solvent applicator subassembly;

FIG. 7 is an exploded perspective view to the same scale as FIG. 6 showing the wiper subassembly that removes the solid and liquid residues from both the lane and pick-up roller;

FIG. 8 is a still further enlarged fragmentary perspective view showing one of the retractable guide roller subassemblies located on the rear corners of the unit; and, FIG. 9 is a schematic of the control system.

Figure 1:
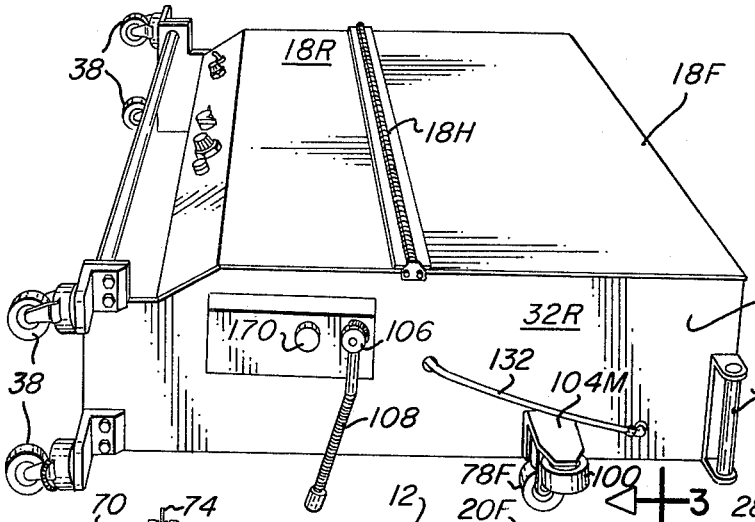
FIG. 1 is a perspective view of the stripper as seen from the right side thereof.

Referring next to the drawings for a detailed description of the present invention and, initially, to FIGS. 1–4 for this purpose, reference numeral 10 has been chosen to designate the lane stripper of the present invention in a general way while numerals 12 and 14 have been selected to similarly connote the solvent applicator and residue removal subassemblies, respectively. Each of the latter subassemblies is further subdivided into other subassemblies, the identification and detailed description of which will be set forth later. In the meantime, brief mention will be made of certain other elements and subassemblies of the unit, several of which are found in the previously patented units that have already been discussed at some length.

To start with, it can be seen that all the functional elements of the unit are housed in an open-bottomed generally rectangular housing 16 having a two-part hinged lid 18R and 18F providing access to rear compartment 20R and front compartment 20F. For purposes of the present description, the front of the unit will be that which faces the pin deck while that which faces the foul line will thus become the rear. In like manner, the forward run of the machine will be that in which it travels from the foul line toward the pin deck. Conversely, of course, the return run will be the one where it comes back to the foul line. Generally speaking, the reversible drive mechanism which has been broadly designated by reference numeral 24 is housed in rear compartment 20R while the applicator and pick-up subassemblies 12 and 14 will be found in front compartment 20F.

Figure 2:
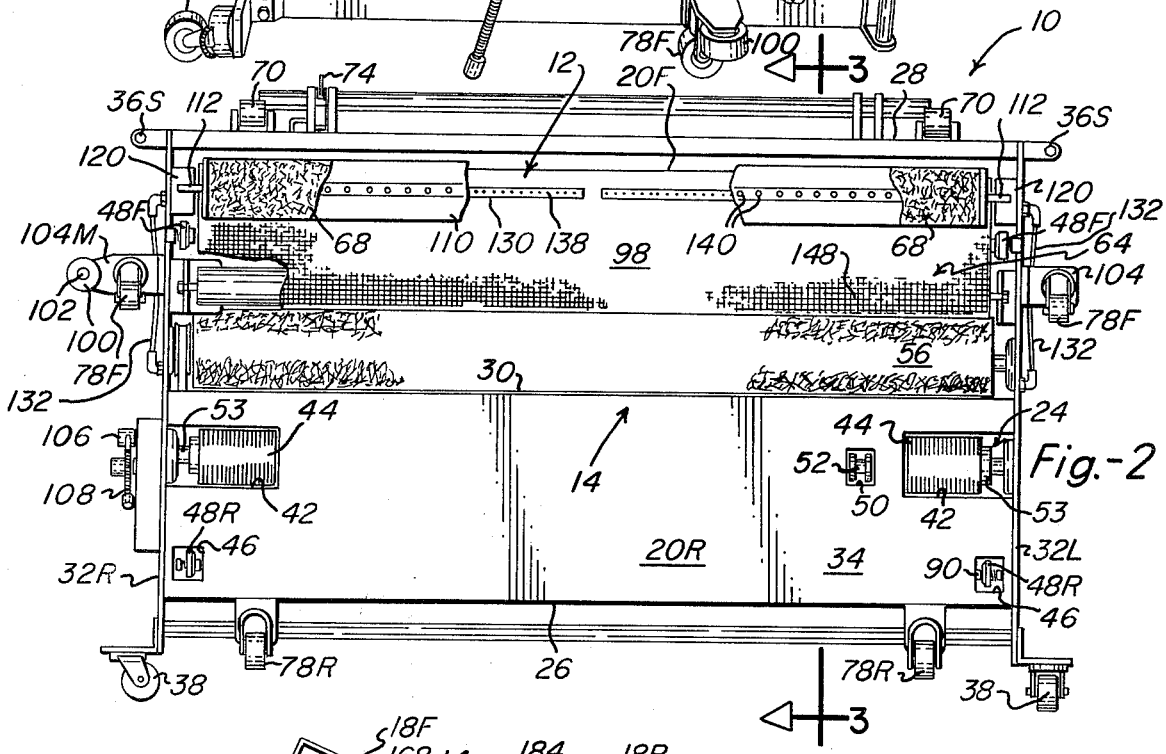
FIG. 2 is a bottom plan view to the same scale as FIG. 1 and with certain portions thereof broken away to better reveal the interior construction.
Figure 3:
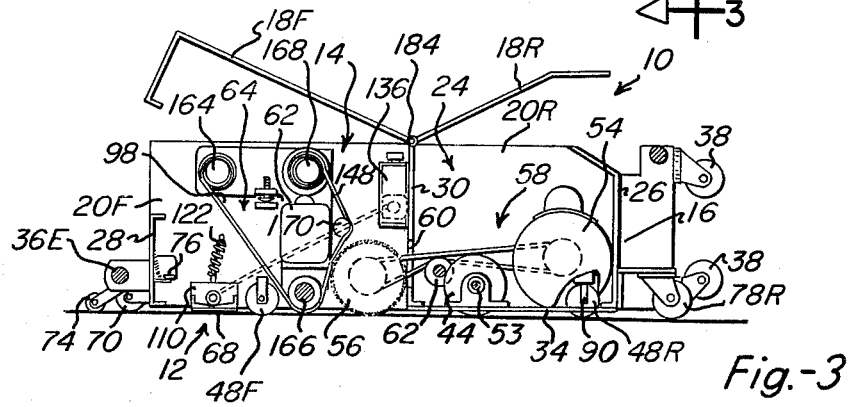
FIG. 3 is a vertical section taken along line 3—3 of FIG. 2 showing the hinged coverplates in elevated position.
Figure 4:
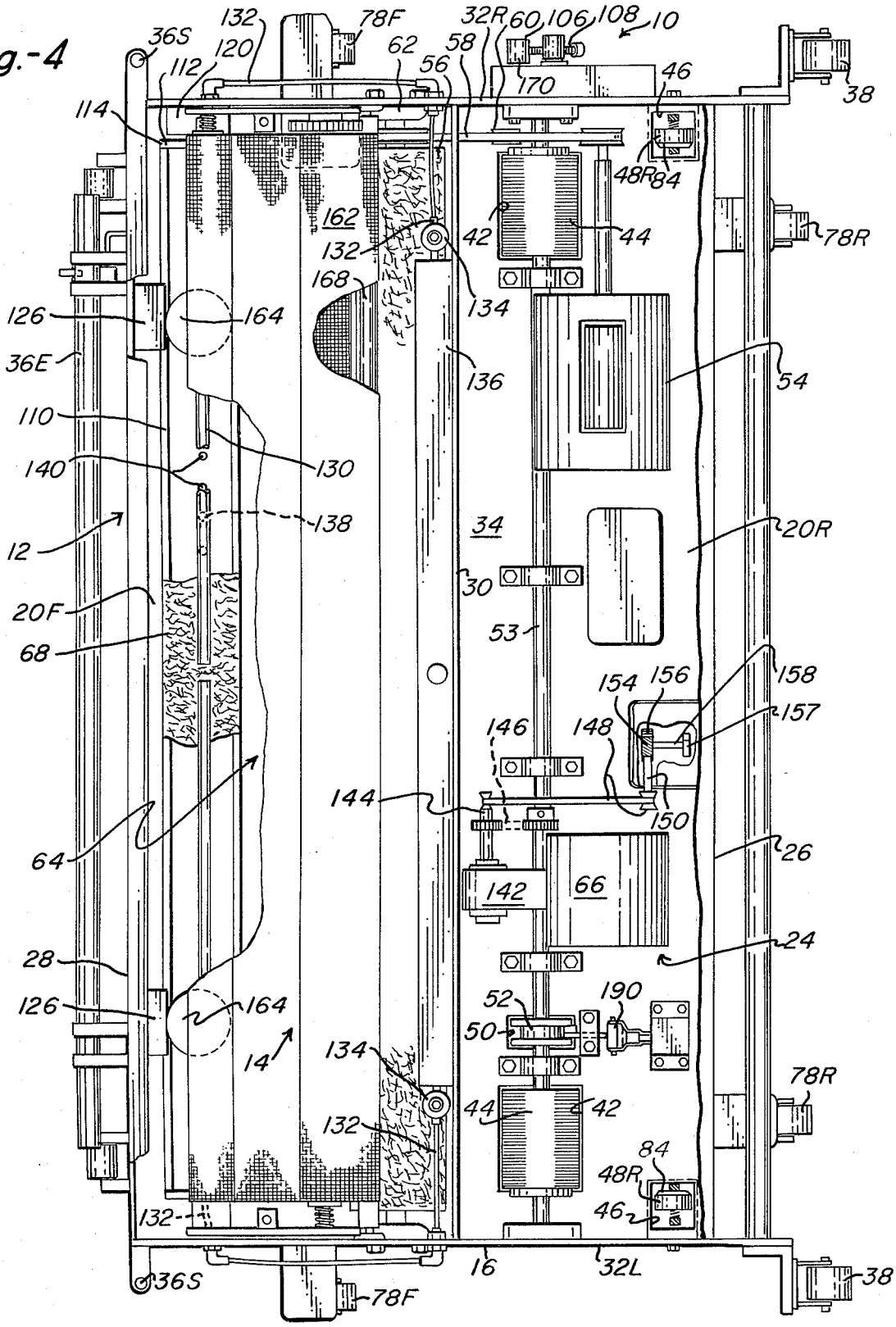
FIG. 4 is a slightly enlarged top plan view of the unit with the coverplates and other of the elements broken away to more clearly reveal the portions that would otherwise be hidden thereby.

In addition to lid 18F, the housing has a rear wall 26, a front wall 28, a transverse partition wall 30 carrying the cover hinge 18H along its top edge, right and left sidewalls 32R and 32L respectively, and a partial bottom wall 34 extending between the partition wall 30 and rear wall 26 so as to cover the rear compartment 20R. Handles 36S are provided on the front outside corners of the housing to facilitate pulling the unit around on a set of four casters 38 provided on its rear end. A third handle 36E extends across the front end of the unit for the purpose of raising up on end. In FIGS. 2, 3 and 4, it will be noted that cut-outs 42 are provided in the bottom panel or floor of the housing 34 through which the drive rollers 44 emerge and engage the lane surface. Other cut-outs 46 expose the retractable guide wheels 48 that run within the ball return gutters (not shown) alongside the lane and perform an important function that will be described presently in connection with FIG. 8. One remaining cut-out 50 exposes solenoid-actuated drive shaft brake 52 which functions upon actuation to release the drive shaft 53. Resting atop floor 34 inside compartment 20R is the electric gear motor 54 which powers roller 56 of the pick-up subassembly 14 located in front compartment 20F that will be described in greater detail presently. The driving connection between motor 54 and roller 56 is by means of a conventional belt and pulley power transfer mechanism that has been broadly designated by reference numeral 58 in FIG. 3 and which passes through opening 60 (FIG. 3) in partition wall 30. Element 62 seen in FIGS. 3 and 4 is a belt-tightening idler of standard design. A separate and completely independent electric motor drive 62 is mounted inside forward compartment 20F against the right bulkhead 32R for driving the moving web wiper subassembly that has been referred to broadly by reference numeral 64 and which forms a part of pick-up subassembly 14 as will appear presently. Still another independent electric motor 66 is located inside compartment 20R and operatively connected to drive shaft 53 in much the same way that gear motor 41 drives drive rollers 40 through speed reduction gearing 42 in U.S. Pat. No. 3,604,037.

Before leaving FIGS. 1-4, it will help in the overall understanding of the unit to describe in detail its round trip excursion from its starting position behind the foul line all the way to the pit at the far end of the lane with special attention being given to its wheeled supports. As the unit is placed in operative position on the approach to the foul line, its drive rollers 44 will be behind the foul line such that its retractable applicator pad 68 lies right on top of the latter. Pick-up roller 56 along with wiper subassembly 64 will both lie behind the foul line. On the front end of the machine (FIGS. 2, 3 and 4) fastened to front wall 28 are a pair of transversely-spaced rollers 70 located inboard of the gutters alongside the lane. The primary function of these rollers is to support the front end of the machine while it is being raised and lowered between its operative and inoperative positions and thus will not scratch or mar the lane surface or the approach thereto. Once the unit is in its operative position, these rollers have no further function until the unit is raised on end once again.

With particular reference to FIG. 5 and also to FIGS. 2, 3 and 4, it can be seen that a spring-biased switch actuator 74 is located slightly out ahead of front rollers 70 in position to drop down into the pit thus releasing switch 76 controlled thereby into its normally open position and reversing drive motor 66 to start the unit on its return trip. At the beginning of the stripping cycle when the unit is located on the approach to the foul line ready to begin its forward run along the lane, its retractable applicator pad 68 is right at the foul line and casters 78F extending laterally out to the side already lie recessed into the gutters beside the lane. These casters 78F cooperate with a second pair 78R located at the rear of the unit to support same in horizontal position while it is moved from lane to lane.

Referring briefly to FIGS. 1, 2, 4 and 8, it can be seen that a pair of retractable wheels 48R are located behind the drive rollers 44. These wheels 48R retract up into the housing 16 under the weight of the machine as it rests on the lane. They also are spring biased into contact with the lane surface behind the foul line by compression springs 80; however, these springs are ineffective to lift its rear end of the machine or the drive rollers carried thereby out of contact with the lane. Wheels 48R are aligned with the inboard margins of the gutters and also biased inwardly thereagainst by compression springs 82. These wheels are spaced apart the prescribed width of the lane and springs 82 merely allow the rollers to yield the quarter of an inch or so necessary to accommodate the minimal variations in lane width. The inner peripheral margin 84 of each wheel is chamfered to cam them into the gutter under the influence of spring 80 and in opposition to the bias of spring 82. Each of these wheels is mounted for rotation on a transversely-extending axle 86 that bridges a downwardly-opening notch 88 in slide block 90. Block 90 is mounted for vertical reciprocating movement within slot 92 in fixed mounting block 94 fastened by bolts 96 to the adjacent sidewall of the housing. Spring 80 normally biases the slide block 90 and the wheel 48R carried thereby down through cut-out 46 in the housing floor. Spring 82, on the other hand, is mounted on axle 86 outboard of the wheel between it and the adjacent vertical leg of the slide block so as to bias the wheel inwardly. It is necessary that these wheels 48R retract as they ride up out of the gutters on the return trip of the machine so that the pick-up roller 56 along with moving web 98 of the wiper subassembly 64 can maintain contact with the lane all the way back to the foul line.

A second set of guide wheels 48F are located at the front end of the machine in position to engage the adjacent edges of the ball gutters and cooperate with wheels 48R at the rear end to maintain the unit aligned with the lane. Wheels 48F differ from wheels 48R in that they are not retractable since the unit has already reached its terminal position before they leave the ball gutters.

During the forward run of the unit, its primary support is derived from drive rollers 44 adjacent the rear and pick-up roller 56 located just ahead of the latter although applicator pad 68 is also in continuous end-to-end lane-engaging contact as well. Roller 56 rotates about a fixed axis as do the drive rollers 44, whereas, pad 68 is more or less yieldably pushed down against the lane surface with insufficient force to raise the pick-up roller free thereof. As a matter of fact, the endless web wiper subassembly 64 is also preferably in continuous wiping contact with the lane surface. During the return run, on the other hand, applicator pad 68 is retracted up into compartment 20F of the housing which leaves the primary support to drive rollers 44 and pick-up roller 56 as before while with the secondary support being provided exclusively by the wiper subassembly 64.

On the approach to the foul line it can be seen that both sets of casters 78F and 78R will lie in contact with the lane surface, thus elevating all three of the lane stripping subassemblies which include applicator subassembly 12, pick-up subassembly 14 and wiper subassembly 64 into inoperative position. Actually, the applicator subassembly is raised into its retracted inoperative position all during the return run of the unit anyway as will be explained presently in connection with FIG. 6 to which detailed reference will soon be made. Equally significant, however, is the fact that once front casters 78F drop off into the gutters, the relatively heavier front end of the unit will drop down onto pad 68 thus rocking same forwardly about drive rollers 44 as fulcrums and lifting the rear casters 78R free of the lane.

Before getting into a detailed description of the subassemblies responsible for the application and removal of the solvent from the lane surface, there remains yet another roller 100 projecting from the right side of the housing out over the gutter on that side. In the particular form illustrated in FIGS. 1, 2, 3 and 4, roller 100 is mounted on pin 102 (FIG. 2) for rotation about a vertical axis and as a part of the same bracket 104M that mounts one of the support rollers 78F. Bracket 104 on the left side includes no provision for mounting a roller like roller 100. This roller has as its sole function that of a bumper for preventing the right side of the machine from striking the photocell located at the foul line that forms a part of the ball return subassembly in a conventional automatic pinsetter. This photocell projects out far enough to possibly be struck by the stripper as it is being placed on the approach to the lane or removed therefrom.

One final element should probably be explained in connection with the first four figures of the drawing before proceeding to those figures on the third sheet and that is feeler switch subassembly 106 mounted on the side of the unit so as to project down into the lane gutter. This switch subassembly has an actuator 108 positioned to engage the ramp (not shown) at the entryway into the gutter as the unit approaches the foul line on its return run. The location and function of this switch subassembly is the same as that of switch 178 in U.S. Pat. No. 3,868,738, namely, to deenergize main drive motor 66 that powers drive rollers 44. One difference, however, is the relocation of feeler 108 farther to the front of the unit so that pick-up roller 58 moves all the way to within approximately one inch of the foul line before the machine stops.

Next, with particular reference to FIGS. 2, 3, 4 and 6, it can be seen that the applicator subassembly 12 includes the retractable pad 68 attached to the underside of an upwardly-opening channel-shaped rigid metal trough or pan 110. The opposite ends of this pan are fitted with T-shaped brackets 112, the crosspieces 114 of which close the open end of the channel while the stem portions 116 slide vertically within guide slots 118 provided in guide blocks 120. These guide blocks 120 are fastened to the inside of the side panels 32 of the housing as are the upper ends of tension springs 122. The lower ends of these same tension springs fasten into the stems 116 of the T-shaped brackets and cooperate therewith to normally maintain pad 68 in retracted inoperative position out of contact with the lane surface.

A pair of solenoids 124 (only one of which has been shown in FIG. 6) are mounted in transversely-spaced relation to a fixed portion 126 of the housing. These solenoids each have the cores 128 thereof attached to the applicator casing 110 alongside the solvent distribution pipes 130. Upon energization, these solenoids actuate simultaneously to lower the applicator pad 68 into its extended operative position in contact with the lane surface thus overcoming the bias exerted thereon by tension springs 122.

Pad 68 is made of an absorbant material, preferably felt, which is capable of receiving a charge of several ounces of solvent and wiping same onto the lane surface in a reasonably uniform manner. Since it has been found that a minute or two is necessary for a charge of solvent to distribute itself evenly throughout the pad, the preferred procedure is to soak the pad by hand in advance of stripping the first lane. During a portion of both the forward and the return runs of the unit, the pad is wetted automatically, however, on the initial run it requires a presoaking.

Solvent distribution pipes 130 are connected to receive fluid through conduits 132 as it passes control valves 134 downstream of reservoir 136. With these valves actuated into open position, the solvent gravitates down to the distribution pipes 130 where it drips out into the pan 110 through apertures 138 in the bottom of each pipe. The bottom of the pan also has a series of apertures 140 through which the solvent enters and wets pad 68.

Now, in FIG. 4 it can be seen that main drive shaft 53 is operatively connected to reversible drive motor 66 through gear box 142, output shaft 144 and a belt and pulley power transfer mechanism broadly indicated by reference numeral 146. A second belt and pulley power transfer mechanism 148 transfers power from output shaft 144 in the gear box to a worm shaft 150 that is journalled for rotation in a suitable housing. Shaft 150 carries a worm 154 which meshes with a pinion 156 mounted on cam shaft 158 that carries a switch-actuating distance cam 157.

No useful purpose will be served by going into the details of this cam, its adjustment, mounting, etc. since it is essentially the same as oiler cam 164 and distance cam 166 which have both been described in considerable detail in U.S. Pat. No. 3,868,738 beginning at line 32 in column 5 and continuing into column 7 down to line 65. The function, however, of cam 157 in the instant unit is somewhat different although analogous to that of oiler cam 164 just mentioned, namely, that of controlling the distance down the lane and back that solvent is dispensed from reservoir 136 into the pan 110. More specifically, cam 157 controls solenoid valves 134 that let solvent pass from the reservoir to the pan. As will be seen presently in connection with the circuit diagram of FIG. 9, valves 134 open at the start of each run and admit solvent to the pad. It has been found, however, that if the pad is continuously supplied with solvent during its complete forward run, the lane becomes too wet and puddles of solvent result that are difficult to pick up. Accordingly, for best results it is preferred that solvent be applied to the pad for only the first fifteen feet or so much like the oil was applied by the machine of U.S. Pat. No. 3,868,738. Beyond fifteen feet or some such distance, the solvent saturating the pad is enough to strip the remainder of the lane which, as already noted, contains considerably less oil than the dressed section. On the other hand, when the unit arrives at the far end of the lane, most of the solvent has been "wicked" out of the pad onto the lane surface which means that there is not enough left to begin stripping the next lane. Accordingly, when motor 66 reverses and all the shafts including cam shaft 158 reverse directions, cam 157 will eventually work its way back around to the point where it allows valves 134 controlled thereby to reopen and admit another charge of solvent to the pad. This takes place during approximately the last fifteen feet of the return run or whatever other distance the cam is set for. Thus, when the machine returns to its starting point and shuts off, applicator pad 68 will already have a sufficient charge of solvent to begin stripping the next lane starting right at the foul line.

Probably the most unique feature of the instant invention is the means by which the solvent, oily residues, dirt and dust are removed from the lane surface following the application of the solvent thereto. From an apparatus standpoint, the subassemblies employed for this purpose do not differ in any major way from buffing subassembly 40 and duster subassembly 50 of assignee's U.S. Pat. No. 3,868,738 or the counterparts 30 and 31 of the U.S. Pat. No. 3,604,037. Functionally, on the other hand, there is very little, if any, real similarity. To begin with, the dusting and buffing subassemblies in these patented units are functionally and mechanically independent of one another. In the machine of U.S. Pat. No. 3,868,738, the buffing and oiling operations are also combined.

The instant unit differs from both of these in that, first of all, no dressing is applied to the lane surface at all. Instead, a heavy application of solvent is applied, not by means of a roller but with a retractable pad.

More significant, however, is the fact that a continuously rotating roller 56 is moving along behind the solvent applicator pad while the latter is in contact with the lane and is constantly picking up most of the excess solvent, the dissolved oily residues, dirt and other contaminants and immediately transferring same to the absorbant curtain 162 of the moving web wiper subassembly 64 before these contaminants can be returned to the lane. Thus, the wet surface of the pick-up roller 56 is constantly being blotted and dried by the absorbant curtain as it wipes across the surface thereof in the manner revealed most clearly in FIG. 3 to which specific reference will now be made along with FIGS. 2, 4 and 7, all of which show certain details of pick-up subassembly 14 and the wiper subassembly 64 that forms an integral part thereof.

The drive for pick-up roller 56 has already been mentioned and, since it is fairly straightforward, no useful purpose would be served by discussing it further other than to point out it operates continuously during both the forward and return runs of the unit and always rotates the same direction, i.e. clockwise as viewed in FIG. 3. Clockwise rotation causes roller 58 to lift the solvent residues and other foreign matter laid down ahead thereof by applicator 68 on its forward run and immediately transfer same to the absorbant curtain 162 of the moving web subassembly that constantly wipes its surface as shown in FIG. 3. Curtain 162, on the other hand, is continuously moving all of supply roll 164 downwardly and rearwardly underneath intermediate roller 166, up and across pick-up roller 56, and onto take-up roller 168 after passing over idler roller 170 located between the latter two. The arrangement is very much like that shown in U.S. Pat. No. 3,868,738 that has already been referred to repeatedly but which only performs a dusting function and no wiping one insofar as drying the surface of the oil applicator. The drive mechanism indicated in a general way by reference numeral 172 and shown in FIG. 7 is, likewise, similar to that of the earlier patented machines and, for this reason, no novelty is predicated thereon. It should be noted, however, that this moving web subassembly operates continuously and in a direction such that it wipes and blots the pick-up roller and then is stored upon take up roll 168 where both the fluid and solid residues remain and are confined for eventual disposal. Electric motor 62 drives the take-up roll and is of the unidirectional type. Both the supply and take-up rolls are removable for purposes of replacing the web.

Now, directing the attention specifically to FIG. 3, it will be seen that intermediate roller 166 of the wiper subassembly is also preferably pressing the absorbant curtain 148 passing therebeneath into continuous end-to-end contact with the lane all during the time the machine is moving. Its function on the forward run is primarily one of spreading out the solvent left by the applicator pad into a thin film and working it into the oil, grit and dust left on the lane surface preparatory to picking these solid and liquid residues up on the surface of pick-up roller 56. Obviously, some preliminary removal of the solid and liquid residues will be picked up by the absorbant curtain before the roller 56 ever reaches them and to this extent, the moving web subassembly 64 performs an advance or first stage wiping function during the forward run which is most beneficial. At the same time, it is spreading out any puddles of liquid on the lane surface and making them easier to remove by means of the pick-up roller. Roller 166 will, of course, be turning the same direction as drive rollers 44 on the forward run but opposite to roller 56, i.e. counterclockwise as seen in FIG. 3. In so doing, it has very little wiping action but more of a blotting one since the web is moving rearwardly while the machine advances. This all changes during the return run at which point no more solvent is being applied to the lane and, furthermore, most of the solid and liquid residues have already been removed therefrom. Now, the drive rollers 44 are turning the same direction as pick-up roller 56, namely, clockwise in FIG. 3 and the latter element is leading rather than trailing the moving web. As it does so, however, it picks up the last vestiges of the liquid and solid residues from the surface of the lane and continues to transfer them to the moving curtain 162. At this point there is normally nothing left on the lane to pick up; nevertheless, the moving web subassembly comes along and gives its surface a final wiping as its roller 166 and web 162 move in a direction to retard or hold back the machine itself as it progresses rearwardly toward the foul line and "home" position.

On its final approach back to the foul line and completion of its stripping cycle, several things take place. To begin with, rear guide wheels 48R ride up the ramps at the lead ends of the ball gutters and partially retract into the housing until they ride up onto the approach surface to the lane. The machine has not stopped at this point but, for all practical purposes, the function of these rear guide wheels has ended. Front guide wheels 48F, of course, remain in guiding relation to the ball gutters. Drive rollers 44 are still operating which they continue to do until pick-up roller 56 therebehind comes back all the way to within an inch or so of the foul line whereupon feeler switch 106 finally actuates as it climbs up the gutter ramp to shut down the machine completely. Note, however, that at this point front casters 78F both still remain in the ball gutters since pick-up roller 56 is well ahead of them on the return run. Therefore, it is only after the unit is pulled manually further out on the lane approach that casters 78F leave the lane gutters and cooperate with casters 78R on the rear end of the machine to lift the drive rollers 44 together with rollers 56 and 166 free of the lane surface. All during the return run, solenoids 124 will be deenergized permitting springs 122 to lift pad 68 up into retracted position against the underside of solvent distributor tubes 130. Once the machine has come to a stop, it can be wheeled to the next lane using handle 38E at its forward end and casters 78R and 78F to support same. After stripping the last lane or at any time inbetween, sufficienT time should be allowed for pan 110 to drain its charge of solvent into pad 68 before the unit is turned up on end otherwise some spillage may occur.

Figure 9:
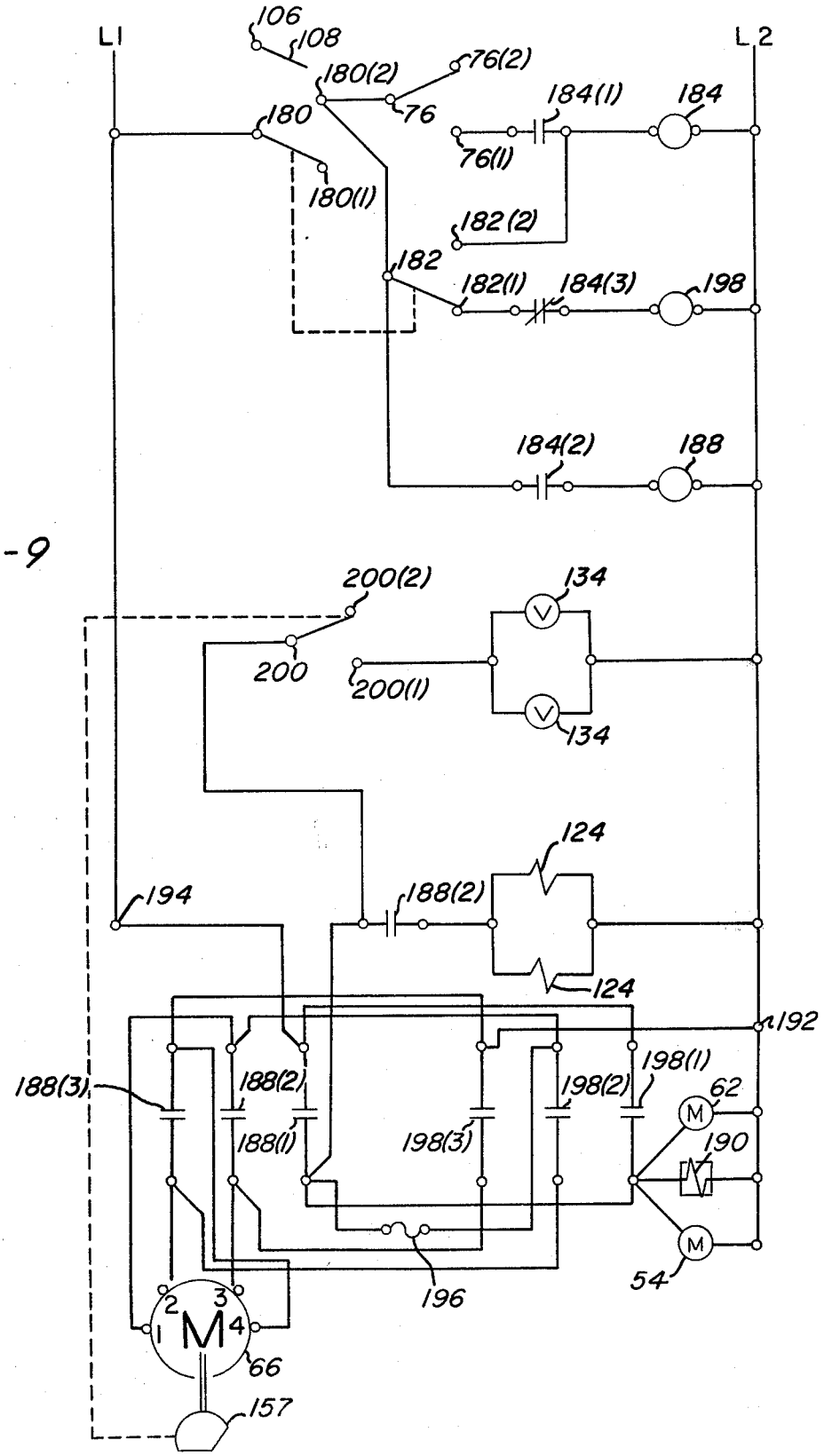

Referring next to FIG. 9, reference numeral 180 indicates the main on-off switch having contacts 180(1) and 180(2). This switch is mechanically linked to switch actuator 108 of switch 106 that is shown most clearly in FIG. 1 such that when switch 180 is actuated onto its contact 180(2) to start the stripping cycle, switch 106 becomes effective to reopen same upon completion thereof as it rides up the ramp leading down into the ball gutter. It is also operatively linked to switch 182 in a manner such that when switch 180 is actuated onto its contact 180(2), switch 182 will be momentarily actuated onto its contact 182(2) so as to energize the coil of multi-contact relay 184. Switch 182 is normally biased onto its contact 184(1) so that as soon as switch 180 is released, switch 182 returns to contact 182(1) while switch 180 remains on its contact 180(2) until switch arm 108 functions as aforementioned to reopen it. Switch 76 is the normally open switch on the front end of the unit that is actuated into closed position onto its contact 76(1) overcoming the bias of spring 186 whenever the machine is resting in horizontal position on the lane but back of the pin pit at its far end. Closure of switch 76, however, is ineffective to start the machine because relay 184 has not been energized and its contacts 184(1) remain open. Upon energization of relay 184, however, a current path is established to the coil of relay 188 through contacts 184(2). With relay 188 energized, its normally open contacts 188(1) close to complete current paths through the motor 62 that operates the moving web wiper subassembly 64, the solenoid 190 that disengages shaft brake 52 and pick-up roller drive motor 54. Through this same normally open contact 188(1) and a second set of its normally open contacts 188(2), current is supplied to the solenoids 124 which lower the applicator pad. Cam-controlled contacts 188(3) also close and energize solenoid valves 134 to deliver solvent from reservoir 136 into the distribution tubes or manifolds 130.

Deferring for the moment a discussion of how solenoid valves 134 are closed and reopened by distance cam 157, the reversing circuit for main drive motor 66 will be set forth. Energization of the coil or relay 188 also closes its normally open contacts 188(3) and 188(4). Closure of contacts 188(3) connects motor contacts 2 and 4 together through tap 192 on line $L_2$. In a similar manner, tap 194 on $L_1$ connects motor contacts 1 and 3 together through 188(1), fuse 196 and contacts 188(2). Motor 66 is thus energized in the forward mode to drive the machine down the lane toward the pin deck.

As soon as the unit reaches the far end of the lane, switch 76 returns to its normally open state against contact 76(2). With switch 182 already on contact 182(1), contacts 184(2) return to their normally open state while normally closed contact 184(3) recloses and establishes a current path to the coil of relay 198. Motors 54 and 62 continue to run because of the current path thereto through tap 194 and normally open contacts 198(1) of relay 198. These same contacts energize solenoid 190 to release the brake. When relay 188 deenergized due to the reopening of contacts 184(2), solenoids 124 deenergize thus raising the pad under the bias exerted upon their cores by the tension springs 122.

To reverse motor 66 and distance cam 157 operated thereby, motor contacts 1 and 2 must be connected together and motor contacts 3 and 4. With reverse relay 198 energized, motor contacts 3 and 4 are connected together through tap 192 on $L_2$ and contacts 198(3). In a similar manner motor contacts 1 and 2 are interconnected through tap 194 on $L_1$, contacts 198(1), fuse 196, over to motor contact 1, back out contact 2 and finally completing the loop through 198(2).

Finally, with regard to the cam-controlled solenoid valves 134 that function upon actuation to release fluid from the reservoir into the distribution manifolds 130 and thence into pan 110, it can be seen that with relay 188 energized on the forward run of the unit, a current path is established all the way to normally open switch 200 through tap 194 on $L_1$ and relay contacts 188(1). Cam 157, however, is set to actuate switch 200 to closed position on its contact 200(1) at the beginning of the stripping cycle thus completing the current path to solenoid valves 134 and actuating them to release solvent to the pad. Note, however, that as the main drive motor continues to advance the unit along the lane, cam 157 which is responsive thereto will eventually release switch 200 to its normally open condition to contact 299(2) whereupon the solenoid valves 134 deenergize and no more solvent is furnished to the pad even though it remains in wiping contact with the lane surface. Now, at the end of the forward run of the machine where switch 76 opens as it falls off the end of the tail plank, relay 188 deenergizes to reopen its contacts 188(1) thus breaking the supply of current to switch 200 which is already in the open state. It should, perhaps, be mentioned at this point that contacts 184(3) of relay 184 are preferably time delayed for a brief interval to permit the unit to come to a complete stop and effect a smooth reversal of direction.

Immediately upon energization of reverse relay 198, contacts 188(1) of relay 188 reopen; however, an alternate path is available from tap 194 on $L_1$ around closed contacts 198(2) through fuse 196 to switch 200. Cam 157 is now in the reverse mode and upon reaching the preset distance back toward the foul line it will once again, actuate switch 200 into closed position thus energizing solenoid valves 134 to fill tray 110. At this point, however, the pad is raised into its inoperative position and is merely being charged with solvent.

Finally, upon reaching the foul line on the return run, switch arm 108 will ride up the ramp leading out of the ball gutter to reopen main on-off switch 180 thus terminating the entire cycle. The rear pair of guide wheels 48R will have ridden up out of the gutter into retracted position on top of the lane by this time and brake solenoid 190 will have deenergized to set the brake on shaft 53. With pad 68 charged with solvent, the machine is ready to be moved to another lane where it can begin another cycle.

What is claimed is:

1. In combination in an automatic bowling lane cleaning apparatus: a carriage; a reversible drive mechanism housed within said carriage including a drive shaft and surface-engaging drive wheels mounted on said shaft operative to advance same along a predetermined course in a forward and reverse direction; solvent applicator means including a wettable pad extending transversely of the carriage mounted for movement relative thereto between an operative position extended into lane-engaging relation and an inoperative position retracted up into the carriage; solvent supply means including a solvent reservoir, a manifold positioned atop the wettable pad adapted to receive a charge of solvent and distribute same along the latter, and valve-controlled means interconnecting the reservoir and manifold operation upon actuation to control the delivery of solvent to the latter; applicator pad shifting means connected to the applicator pad operative upon actuation and deactuation to extend and retract same; first control means responsive to the position of the carriage along the lane during the forward run thereof to actuate the reversible drive means so as to commence the return run, and said first control means being effective upon completion of the forward run to act upon the shifting means in a manner to retract the applicator pad; residue removal means including a pick-up roller having an absorbant surface in continuous side-to-side contact with the lane surface and drive means for rotating same, said roller being positioned and adapted to remove the solvent applied to the lane by the applicator pad during the forward run and both the solid and liquid residues remaining during the return run; solvent transfer means including an absorbant curtain, supply and storage rollers so arranged relative to one another and to the pick-up roller as to remove at least a substantial proportion of the liquid residues removed thereby in advance of their being redeposited on the lane surface; curtain drive means connected to the solvent transfer means for continuously moving a fresh area of the curtain across the pick-up roller; manually adjustable means connected to the solvent supply means operative to vary the interval during the forward and return runs of the carriage during which solvent is transferred to the applicator pad; and, second control means responsive to the return of the carriage to its starting point effective to shut-off the drive therefor along with those for the curtain and pick-up roller.

2. The combination as set forth in claim 1 wherein front and rear pairs of guide rollers are mounted upon the carriage for movement therewith in recessed relation within the ball gutters alongside a bowling lane, said rollers being positioned and adapted while so recessed to engage the side margins of the lane and guide the movements of the carriage therealong; and, means comprising yieldable mountings mounting the rear pair of guide rollers for retractable movement into an elevated position, said mountings being effective to yield and maintain the drive wheels and pick-up roller in lane-engaging contact whenever said rear guide rollers are riding upon surfaces outside the ball gutters elevated thereabove.

3. The combination as set forth in claim 2 wherein: the front and rear pairs of guide rollers are each journalled for rotation about transverse horizontally-disposed axes; and, wherein, spring means contact each of said rollers normally biasing same laterally into contact with the side margins of said lane.

4. The combination as set forth in claim 1 wherein: the first control means comprises a switch responsive to the arrival of the carriage at the far end of the lane on its forward run.

5. The combination as set forth in claim 1 wherein: the drive means for the pick-up roller turns the latter in a direction to retard movement of the carriage on the forward run thereof.

6. The combination as set forth in claim 1 wherein: the drive means for the curtain move same in the same direction that the surface of the pick-up roller is moving that lies in contact therewith.

7. The combination as set forth in claim 1 wherein: the manually adjustable means for controlling the interval during which solvent is applied to the applicator pad comprises a cam-actuated switch for actuating and de-actuating the valve-controlled means of the solvent supply means, and cam-actuated switch being operatively connected to the drive shaft and responsive thereto.

8. The combination as set forth in claim 7 wherein: the cam-actuated switch is responsive to reversal of the direction of drive shaft rotation to supply solvent to the applicator pad for the same interval during the return run of the carriage that solvent was supplied thereto during its forward run.

9. The combination as set forth in claim 1 wherein: the solvent transfer means includes a third roller disposed between the supply and storage rollers positioned and adapted to hold the curtain in surface engaging contact with the lane in advance of said curtain moving across said pick-up roller.

10. The combination as set forth in claim 1 wherein: spring means connected between the carriage and applicator pad normally bias the latter into retracted position; and, wherein the applicator pad shifting means is operative upon actuation to extend the applicator pad into yieldable lane-engaging contact overriding the bias exerted thereon by said spring means.

* * * * *